US008092002B2

(12) United States Patent
Ito

(10) Patent No.: US 8,092,002 B2
(45) Date of Patent: Jan. 10, 2012

(54) LIQUID DROPLET EJECTION HEAD AND METHOD FOR MANUFACTURING THE SAME

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 168 days.

(21) Appl. No.: 12/414,057

(22) Filed: Mar. 30, 2009

(65) Prior Publication Data

US 2009/0244188 A1 Oct. 1, 2009

(30) Foreign Application Priority Data

Mar. 29, 2008 (JP) ..... 2008-088923

(51) Int. Cl.
*B41J 2/17* (2006.01)
*B41J 2/045* (2006.01)

(52) U.S. Cl. ..... 347/94; 347/68; 347/71

(58) Field of Classification Search ..... 347/65, 347/68–72, 94
See application file for complete search history.

(56) References Cited

U.S. PATENT DOCUMENTS 6,955,418 B2 10/2005 Ito
7,008,049 B2 * 3/2006 Katayama ..... 347/71

FOREIGN PATENT DOCUMENTS

JP 2004-25636 6/2002
JP 2006-347036 12/2006

* cited by examiner

*Primary Examiner* — Geoffrey Mruk
(74) *Attorney, Agent, or Firm* — Frommer Lawrence & Haug LLP

(57) ABSTRACT

An object of the present invention is to provide a liquid droplet ejection head capable of securing sealing of a common liquid chamber and realizing a high damper effect while suppressing a driving energy of the liquid droplet ejection head. A passage unit includes manifold plates, and a damper plate which is stacked on the manifold plates and has a damper wall facing a common liquid chamber. The damper plate is constituted by a base portion having a damping space at a position corresponding to the manifold holes in plan view, and a resin portion stacked on the base portion. The resin portion is formed to cover at least a portion above and around the damping space to constitute the damper wall, be smaller in a contour shape than the common liquid chamber in plan view, and be stored in the manifold holes.

6 Claims, 8 Drawing Sheets

LIQUID DROPLET EJECTION HEAD AND METHOD FOR MANUFACTURING THE SAME

CROSS-REFERENCE TO RELATED APPLICATION

This application claims priority to and the benefit of Japanese Patent Application No. 2008-088923, filed Mar. 29, 2008, the entire disclosure of which is incorporated herein by reference.

BACKGROUND OF THE INVENTION

1. Field of the Invention

The present invention relates to a liquid droplet ejection head, such as an ink jet head mounted on an ink jet printer, including a passage unit, and a method for manufacturing the liquid droplet ejection head.

2. Description of the Related Art

An ink jet head that is one example of a liquid droplet ejection head includes a passage unit and an actuator. Liquid passages are formed in the passage unit, and are constituted by: a plurality of nozzles configured to eject liquid droplets; a common ink chamber connected to a liquid supply source; a plurality of pressure chambers communicated with the common ink chamber; and an outflow passage which causes the pressure chamber and the nozzle to be communicated with each other. The passage unit is constituted by stacking a plurality of plates having holes and/or grooves which form the liquid passages, and is structured such that a manifold plate forming the common ink chamber and other plates are disposed as intermediate layers between a pressure chamber plate forming the pressure chamber and a nozzle plate forming the nozzle (see Japanese Laid-Open Patent Application Publication 2004-25636 for example). The plates other than the nozzle plate are generally metal plates.

In accordance with this ink jet head, the actuator selectively drives to apply an ejection pressure to an ink stored in the corresponding pressure chamber. Thus, ink droplets are ejected outside from a nozzle hole communicated with this pressure chamber, and the ink is supplied from the common ink chamber to the pressure chamber by a negative pressure.

The ejection pressure generated in the pressure chamber selected at this time contains not only forward components transmitted toward the nozzle hole but also backward components transmitted toward the common ink chamber. Therefore, the pressure may reach the other pressure chambers by the backward components through the common ink chamber, i.e., so-called cross talk may occur. On this account, the passage unit includes as the intermediate layer a damper plate stacked on the manifold plate. Formed at a portion of the damper plate which portion corresponds to the common ink chamber are: a damping space formed by forming a recess on a surface of the damper plate which surface is opposite a surface facing the common ink chamber; and a thin damper wall. By stacking the other plate on the damper plate such that the damping space is closed, a damper chamber is defined by the damper wall separately from the common ink chamber. In a case where the backward components of the ejection pressure are transmitted backward from the pressure chamber to the common ink chamber, pressure fluctuations caused by the backward components are absorbed by elastic deformation of the damper wall, and this damps the pressure fluctuations in the common ink chamber.

To improve such damper effect, it is contemplated that, for example, the area of the damper wall is increased. However, it has been contemplated in recent years that the flexibility of the damper wall is further improved since the ink jet head has been reduced in size.

To obtain the high damper effect in the case of a metal damper plate used in Japanese Laid-Open Patent Application Publication 2004-25636, it is contemplated that the thickness of the damper wall is reduced. However, an ingot of a metal material that is a raw material of the damper plate contains a small amount of impurities including an additive injected thereto at the time of manufacturing. Therefore, in a case where the thickness of the damper wall is reduced to be the same level as the particle diameter of the impurity, the impurity in the damper wall may fall off, and this may cause a partial damage or crack on the damper wall. If such damage or crack forms a through hole on the damper wall, and the common ink chamber and the damper chamber are communicated with each other by this through hole, liquid may intrude from the common ink chamber to the damper chamber, or air may intrude from the damper chamber to the common ink chamber.

Moreover, Japanese Laid-Open Patent Application Publication 2006-347036 proposes the passage unit in which the damper plate is constituted by a metal base portion and a resin sheet, and the resin sheet is interposed between the base portion and the manifold plate. Herein, a portion corresponding to the damper wall is the resin sheet.

However, in a case where the portion corresponding to the damper wall is made of a resin material as in Japanese Laid-Open Patent Application Publication 2006-347036, the resin material may allow a gas to be transmitted therethrough by its nature. To maintain meniscus of the ink in the nozzle, an ink passage in the ink jet head is normally maintained in a negative pressure state. Moreover, since the damper plate is constituted by the metal base portion and the resin sheet, and the resin sheet is stacked on the entire surface of the base portion, a hole that forms the outflow passage needs to be formed on the resin sheet so as to penetrate the resin sheet. Therefore, the outflow passage increases in length by the thickness of the resin sheet, and this increases a passage resistance of the outflow passage. On this account, to secure an adequate ejection pressure for ejecting the ink droplets from the nozzle, the drive voltage of the actuator needs to be increased. Moreover, to achieve a desired liquid passage resistance of the outflow passage, it is necessary to accurately process a cross-sectional shape of the outflow passage, so that the step of processing the outflow passage with respect to the resin sheet may require time, labor, and cost.

SUMMARY OF THE INVENTION

An object of the present invention is to provide a liquid droplet ejection head capable of securing sealing of a common liquid chamber and attaining a high damper effect while suppressing a driving energy of the liquid droplet ejection head.

To achieve the above object, a liquid droplet ejection head according to the present invention includes: a passage unit including a plurality of nozzles configured to eject liquid droplets, a plurality of pressure chambers each configured to be communicated through an outflow passage with the nozzle, a common liquid chamber configured to supply liquid from a liquid supply source to the pressure chambers, and a damper chamber configured to absorb pressure fluctuations of the common liquid chamber; and an energy generator configured to apply an ejection pressure to the liquid in the pressure chamber, wherein: the passage unit includes a manifold plate having a manifold hole constituting the common liquid chamber, and a damper plate which is stacked on the manifold plate and includes a damper wall facing the common liquid chamber; the damper plate includes a base portion on which a damping space constituting the damper chamber is formed at a position corresponding to the manifold hole in plan view, and a resin portion which is disposed on one surface of the base portion which surface faces the manifold plate and is elastically deformable; and the resin portion is provided to cover at least a portion above and around the damping space so as to form the damper wall, and is smaller in a contour shape than the common liquid chamber in plan view so as to be stored in the manifold hole.

In accordance with this configuration, since the resin portion of the damper plate is stored in the common liquid chamber, the outflow passage can be shortened by the thickness of the resin portion while improving the flexibility of the damper wall to increase the damper effect. Therefore, liquid passage resistance of the outflow passage can be reduced, and the drive voltage of the actuator can be lowered. In addition, sealing between the common liquid chamber and the damper chamber can be secured.

The damping space may be smaller in the contour shape than the resin portion in plan view. In accordance with this configuration, on the base portion in plan view, a ring-shaped region surrounding a region corresponding to the damping space is located inside a contour line of the manifold hole. However, since both the ring-shaped region and the region corresponding to the damping space are covered with the resin portion, the sealing between the common liquid chamber and the damper chamber can be secured.

The damping space may be constituted by a recess formed on one surface of the base portion which surface is opposite a surface facing the common liquid chamber; and the damper wall may be constituted by a thin portion left by forming the recess on the base portion, and a covering portion which is a part of the resin portion and covers the thin portion. In accordance with this configuration, the thin portion of the damper plate is reduced in thickness to increase an effect of damping the backward components of the ejection pressure. With this, even if a gap is formed on the thin portion, communication between the common liquid chamber and the damper chamber via the gap can be prevented by the resin portion.

The recess may be formed by half-etching a region corresponding to the recess. In accordance with this configuration, although a peripheral portion of the thin portion tends to be a thinnest portion by etching liquid, the thinnest portion is covered with the resin portion which is larger in the contour shape than the thin portion in plan view. Therefore, the communication between the common liquid chamber and the damper chamber can be effectively prevented even at the thinnest portion where the gap tends to be formed.

The damping space may be constituted by a through hole penetrating through the base portion, and the damper wall may be constituted by a covering portion which is a part of the resin portion and covers one opening of the through hole. With this configuration, the sealing of the common liquid chamber can be secured by the resin portion, and the damper wall having high effect of damping the backward components of the ejection pressure can be constituted by the resin portion which is elastically deformable.

The passage unit may further include a nozzle plate forming the nozzles and a pressure chamber plate forming the pressure chambers, and the pressure chamber plate, the manifold plate, the damper plate, and the nozzle plate may be staked in this order in a stack direction.

Moreover, a method for manufacturing a liquid droplet ejection head according to the present invention is a method for manufacturing a liquid droplet ejection head including: a passage unit having a plurality of nozzles configured to eject liquid droplets, a plurality of pressure chambers each configured to be communicated through an outflow passage with each of the nozzles, a common liquid chamber configured to supply liquid from a liquid supply source to the pressure chambers, and a damper chamber configured to absorb pressure fluctuations of the common liquid chamber, and formed by stacking a plurality of plates on one another; and an energy generator configured to apply an ejection pressure to the liquid in the pressure chamber, the method including the steps of: forming a manifold plate having a manifold hole constituting the common liquid chamber; forming a damper plate having a damping space formed at a position corresponding to the manifold hole in plan view and a damper wall covering the damping space; and stacking the manifold plate on the damper plate to constitute the common liquid chamber and the damper chamber, wherein: the step of forming the damper plate includes a step of forming the damping space on a base portion, and a step of forming a resin portion on a surface of the base portion which surface faces the manifold plate and at a portion above and around the damping space to form the damper wall; and in the step of stacking the manifold plate on the damper plate, the resin portion is stored in the manifold hole.

In accordance with this configuration, since the resin portion is placed inside the common liquid chamber, the outflow passage can be shortened by the thickness of the resin portion while improving the flexibility of the damper wall to increase the damper effect. Therefore, the liquid passage resistance of the outflow passage can be reduced, and the drive voltage of the actuator can be lowered. In addition, the sealing between the common liquid chamber and the damper chamber can be secured.

The step of forming the damper plate includes a step of forming a substrate formed by stacking a resin layer on the base portion before the step of forming the damping space on the base portion, and in the step of forming the resin portion, the resin layer is etched such that the resin portion is left on the surface of the base portion which surface faces the manifold plate and at the portion above and around the damping space. In accordance with this configuration, the damper plate having the resin portion of the above shape can be formed easily and surely.

In the step of forming the damping space on the base portion, a recess is formed as the damping space on a surface of the base portion which surface is opposite the surface facing the common liquid chamber, and a part of the base portion remains as a thin portion on a common liquid chamber side of the base portion; and in the step of forming the resin portion, the damper wall is constituted by the thin portion and a covering portion which is a part of the resin portion and covers the thin portion. In accordance with this configuration, the thin portion of the damper plate is reduced in thickness to increase the effect of damping the backward components of the ejection pressure. With this, even if the gap is formed on the thin portion, the communication between the common liquid chamber and the damper chamber via the gap can be prevented by the resin portion.

Moreover, the step of forming the damping space on the base portion may include: a step of masking the damper plate except for a region corresponding to the recess; and a step of half-etching the region corresponding to the recess by etching liquid. In this configuration, although the peripheral portion of the thin portion tends to be the thinnest portion by the etching liquid, the thinnest portion is covered with the resin portion which is larger in the contour shape than the thin portion in plan view. Therefore, the communication between the common liquid chamber and the damper chamber can be effectively prevented even at the thinnest portion where the gap tends to be formed.

In the step of forming the damping space on the base portion, a through hole penetrating through the base portion is formed as the damping space; and in the step of forming the resin portion, the damper wall is constituted by a covering portion which is a part of the resin portion and covers one opening of the through hole. In this configuration, the sealing of the common liquid chamber can be secured by the resin portion, and the damper wall having high damper effect can be constituted by the resin portion which is elastically deformable.

DESCRIPTION OF THE PREFERRED EMBODIMENTS

Hereinafter, embodiments of a liquid droplet ejection head according to the present invention will be explained in reference to the drawings. By way of example, an ink jet head mounted on an ink jet printer will be described. In the following explanation, a direction in which an ink is ejected from the ink jet head is referred to as a downward direction, and a direction opposite the downward direction is an upward direction.

Figure 1:
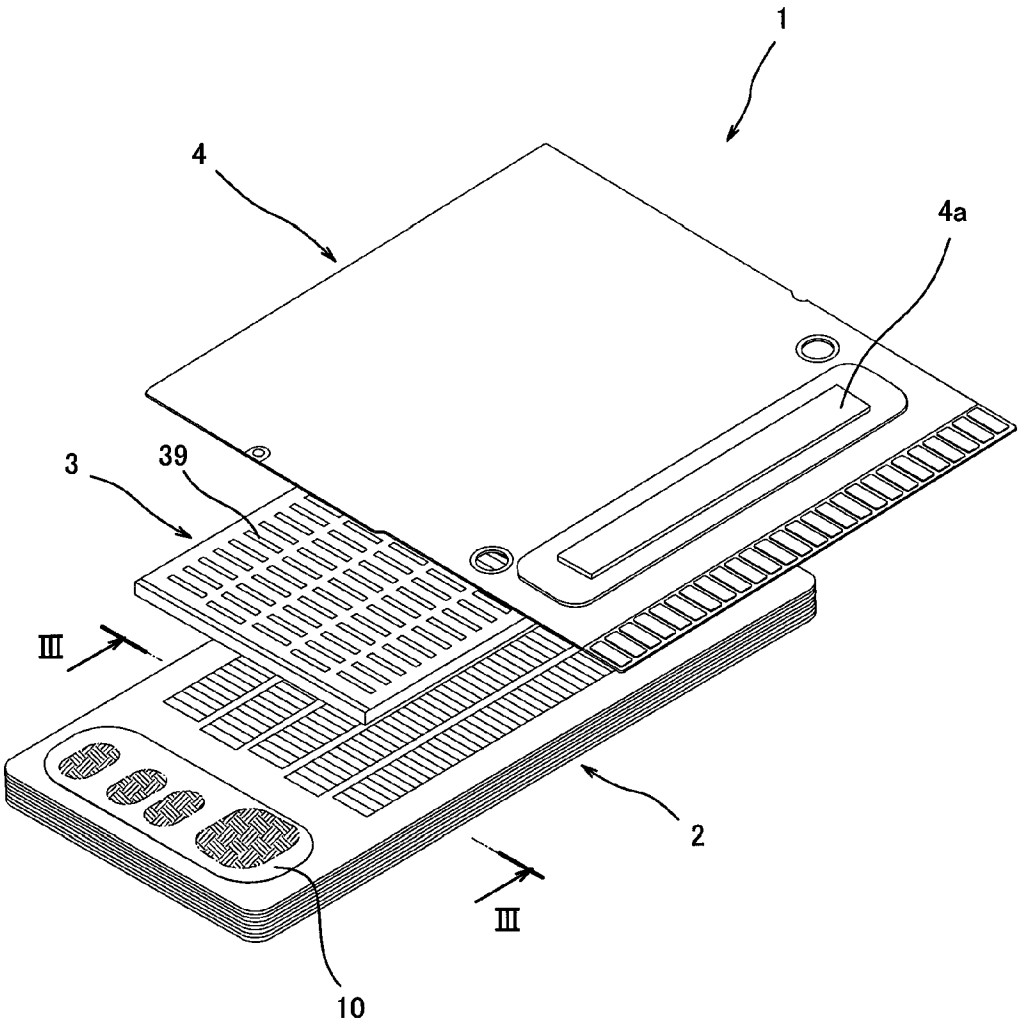
FIG. 1 is an exploded perspective view of an ink jet head including a passage unit according to Embodiment 1 of the present invention.

FIG. 1 is an exploded perspective view of the ink jet head according to Embodiment 1 of the present invention. As shown in FIG. 1, an ink jet head 1 (liquid droplet ejection head) includes a passage unit 2 constituted by stacking a plurality of plates, and a piezoelectric actuator 3 (energy generator) stacked on the passage unit 2 so as to overlap the passage unit 2 from above. A flexible wire member 4 is joined to the actuator 3 so as to overlap the actuator 3 from above. A plurality of surface electrodes 39 are printed on an upper surface of the actuator 3. The surface electrodes 39 and terminals, not shown, exposed on a lower surface of the flexible wire member 4 are joined to each other via, for example, an electrically conductive material to be electrically connected to each other. An IC chip 4*a* (see FIG. 1) is mounted on the flexible wire member 4. The IC chip 4*a* incorporates a drive circuit configured to output an electric signal for driving the actuator 3 in accordance with print data.

Figure 2:
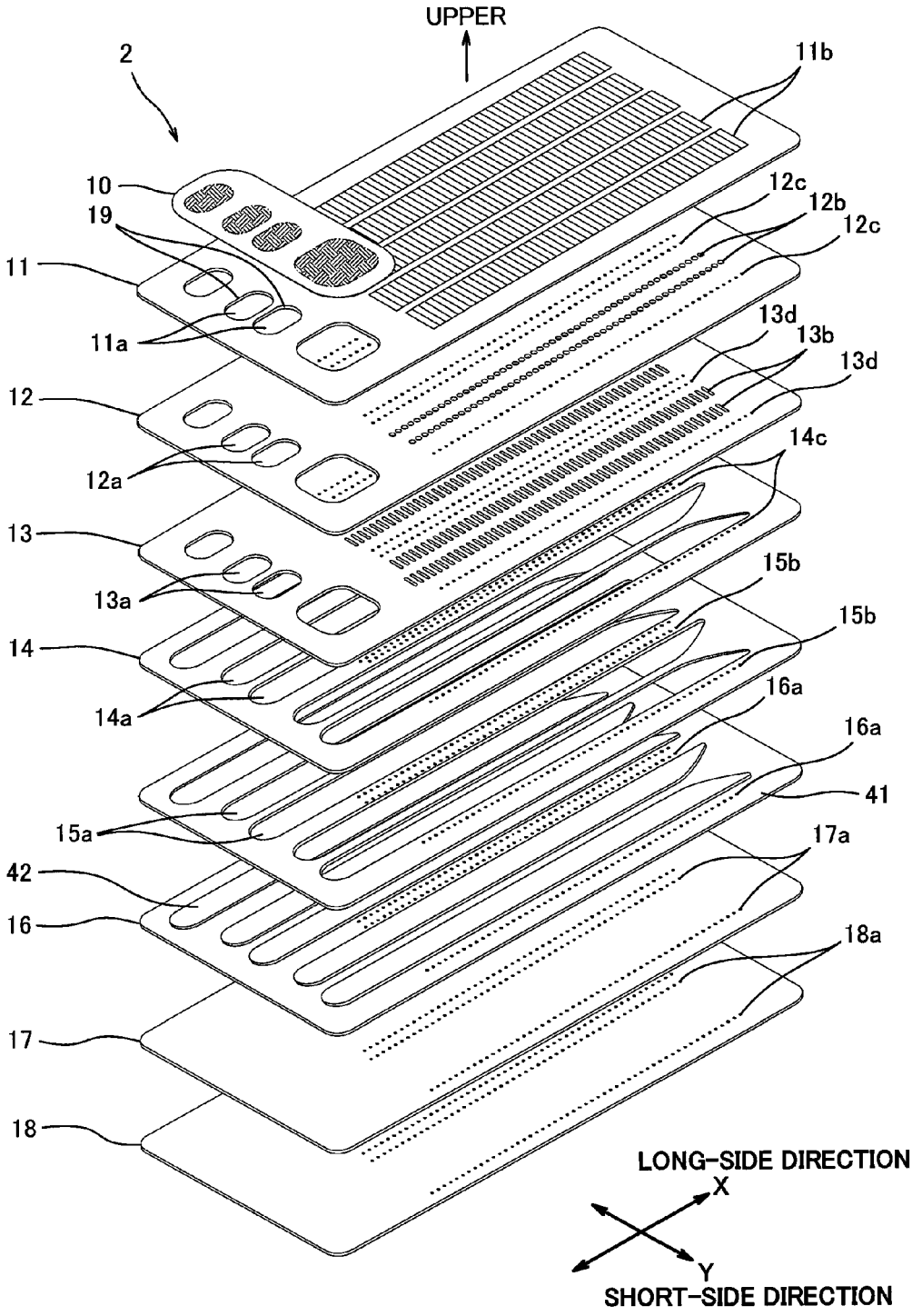
FIG. 2 is an exploded perspective view of the passage unit shown in FIG. 1.

FIG. 2 is an exploded perspective view of the passage unit 2 shown in FIG. 1. The passage unit 2 is configured to include a pressure chamber plate 11, first and second connection passage plates 12 and 13, first and second manifold plates 14 and 15, a damper plate 16, a cover plate 17, and a nozzle plate 18 which are adhesively stacked in this order from the top.

Each of the plates 11 to 17 is a metal plate made of 42% nickel alloy steel, stainless steel, or the like, and the nozzle plate 18 that is a lowermost layer is formed by a synthetic resin material, such as polyimide. Although details will be described later, the damper plate 16 is constituted by a composite plate formed by stacking a metal base portion 41 and a resin portion 42. The plates 11 to 18 are formed to have the same rectangular outer shape as one another in plan view (hereinafter, a long-side direction may be referred to as an X direction, and a short-side direction may be referred to as a Y direction), and each of the plates 11 to 18 has a thickness of about 50 to 150 μm. Predetermined openings and/or grooves are formed on the plates 11 to 18 by etching, laser beam machining, plasma jet machining, or the like. By adhesively stacking the plates 11 to 18, these openings and/or grooves are communicated with one another to form ink passages of the passage unit 2, so that four types of inks flow through the ink passages, respectively.

On the pressure chamber plate 11, a large number of pressure chamber holes 11*b* each of which is rectangular and elongated in the short-side direction are formed to penetrate therethrough. A plurality of the pressure chamber holes 11*b* are arranged along the long-side direction, and five columns of the pressure chamber holes 11*b* are formed along the short-side direction. Among these five columns, two columns located on the right side in FIG. 2 are used for black, and the remaining three columns are used for cyan, magenta, and yellow, respectively. In addition, four ink supply holes 11*a* arranged along the short-side direction are formed at one end portion in the long-side direction of the pressure chamber plate 11 to penetrate through the pressure chamber plate 11. Upper surface openings of the ink supply holes 11*a* are ink inflow openings 19 (liquid inflow openings) through which the inks are supplied from external ink tanks, not shown. One ink inflow opening 19 which is located on the right side in FIG. 2 and is large is used for a black ink, and the remaining three ink inflow openings 19 are used for a cyan ink, a magenta ink, and a yellow ink, respectively. The ink inflow openings 19 are covered with a filter 10 to remove dust contained in the inks to be supplied.

On the first connection passage plate 12, a large number of through holes 12*b* communicated with one end portions of the pressure chamber holes 11*b*, respectively, a large number of outflow through holes 12*c* communicated with the other end portions of the pressure chamber holes 11*b*, respectively, and four ink supply holes 12*a* communicated with the ink supply holes 11*a*, respectively, are formed to penetrate therethrough. On the second connection passage plate 13, a large number of recessed grooves 13*b*, one end portions of which are communicated with the through holes 12*b*, respectively, are formed. The recessed grooves 13*b* are arranged below the pressure chamber holes 11*b*, and communication holes 13*c* (see FIG. 3) are formed at the other end portions of the recessed grooves 13*b*, respectively, to penetrate through the second connection passage plate 13. In addition, on the second connection passage plate 13, a large number of outflow through holes 13*d* communicated with the outflow through holes 12*c*, respectively, and four ink supply holes 13*a* communicated with the ink supply holes 12*a*, respectively, are formed to penetrate therethrough.

On the first manifold plate 14, five first manifold holes 14*a* arranged below the columns of the pressure chamber holes to extend along the long-side direction (direction in which the pressure chamber holes are arranged) are formed to penetrate therethrough. On the second manifold plate 15, five second manifold holes 15*a* communicated with the first manifold holes 14*a*, respectively, are formed to penetrate therethrough. Each of the first manifold holes 14*a* is communicated with a plurality of the outflow through holes 13*d* communicated with the pressure chamber holes of the corresponding column. Moreover, one end portions in the long-side direction of the first and second manifold holes 14*a* and 15*a* are communicated with the ink supply holes 13*a*. The ink supply hole 13*a* located on the right side in FIG. 3 for the black ink is communicated with two first manifold holes 14*a* and two second manifold holes 15*a* located on the right side in FIG. 3, and the remaining ink supply holes 13*a* for the other color inks are communicated with the first manifold holes 14*a*, respectively, and the second manifold holes 15*a*, respectively. In addition, on the first manifold plate 14, a large number of outflow through holes 14*c* communicated with the outflow through holes 13*d*, respectively, are formed to penetrate therethrough. On the second manifold plate 15, a large number of outflow through holes 15*b* communicated with the outflow through holes 14*c*, respectively, are formed to penetrate therethrough.

The damper plate 16 is formed by stacking the resin portion 42 on an upper surface of the metal base portion 41. On the damper plate 16, a large number of outflow through holes 16*a* communicated with the outflow through holes 15*b*, respectively, are formed to penetrate therethrough. In addition, a recess 41*a* which constitutes a damper space is formed on a surface of the damper plate 16 which surface is opposite the surface on which the resin portion 42 is formed.

On the cover plate 17, a large number of outflow through holes 17*a* communicated with the outflow through holes 16*a*, respectively, are formed to penetrate therethrough.

On the nozzle plate 18, a large number of nozzles 18*a* communicated with the outflow through holes 17*a*, respectively, are formed to penetrate therethrough. The nozzles 18*a* are arranged in the long-side direction to form five columns. Two columns located on the near side in FIG. 2 are used for the black ink, and the remaining three columns, not shown, are used for the cyan ink, the magenta ink, and the yellow ink, respectively.

Figure 3:
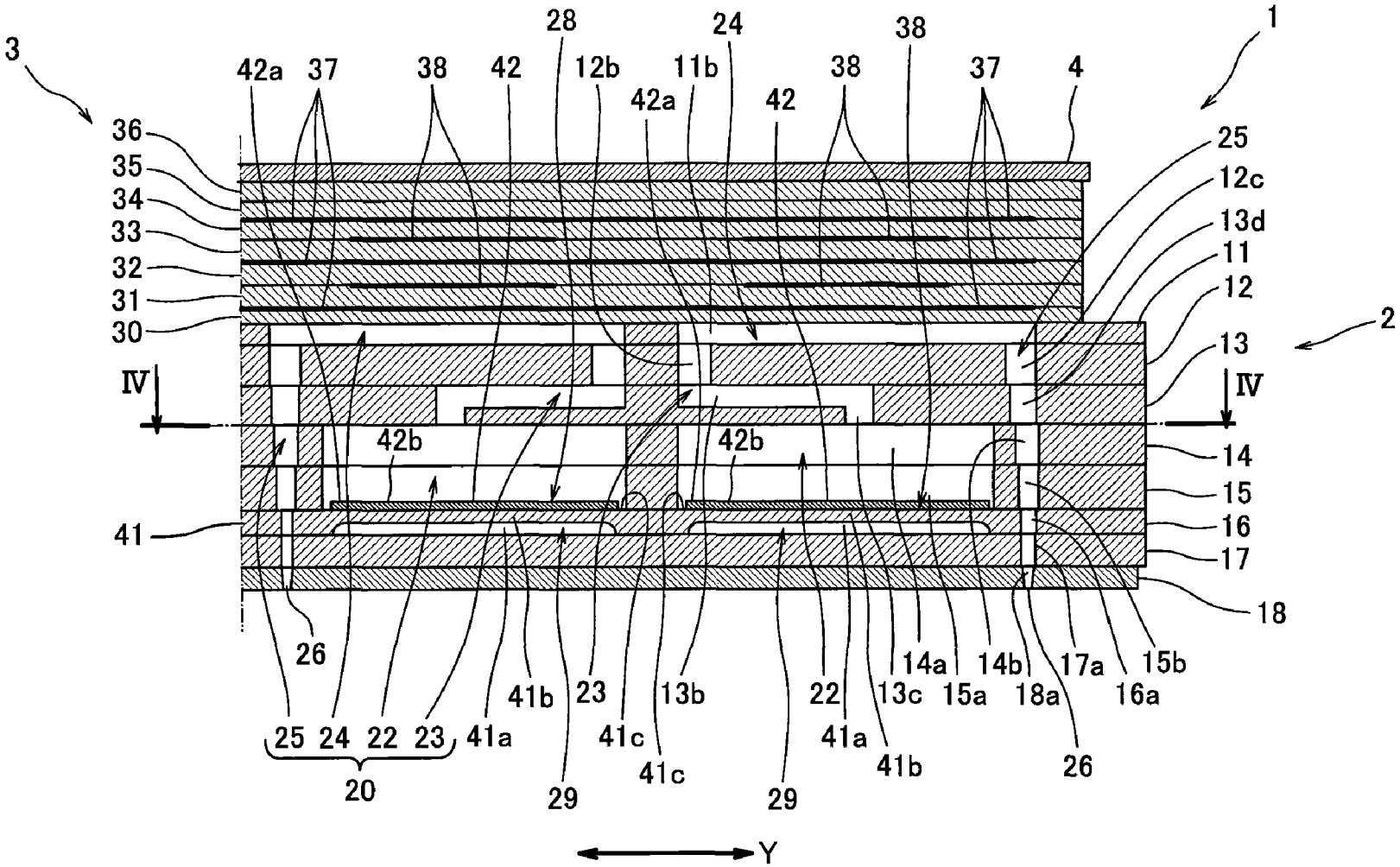
FIG. 3 shows the ink jet head in which the passage unit and an actuator shown in FIG. 1 are adhesively stacked on each other, and is a cross-sectional view taken along line III-III of FIG. 1.

FIG. 3 shows the ink jet head 1 in which the passage unit 2 and the actuator 3 shown in FIG. 1 are adhesively stacked on each other, and is a partial cross-sectional view taken along line III-III of FIG. 1. As shown in FIG. 3, ink passages 20 are formed by stacking the plates 11 to 18. Each of the ink passages 20 guides one ink from the ink inflow opening 19 (see FIG. 2) which opens on an upper surface of the pressure chamber plate 11 to an ejection opening 26 of the nozzle 18*a* which opens on a lower surface of the nozzle plate 18.

Specifically, the first and second manifold holes 14*a* and 15*a* are vertically connected to each other, an upper opening of the first manifold hole 14*a* is closed by the second connection passage plate 13, and a lower opening of the second manifold hole 15*a* is closed by the damper plate 16. With this, five common ink chambers (common liquid chambers) 22 are formed to be lined up in the short-side direction. One end portion in the long-side direction of the common ink chamber 22 is communicated with the ink inflow opening 19 through an ink supply passage (not shown) formed by vertically connecting the ink supply holes 11*a*, 12*a*, and 13*a* (see FIG. 2).

Moreover, the recess 41*a* formed on a lower surface of the base portion 41 to open downwardly is closed by the upper surface of the cover plate 17, thereby forming a damper chamber 29. Five damper chambers 29 are lined up in the short-side direction so as to correspond to the common ink chambers 22, respectively.

Each of the common ink chambers 22 extends in the long-side direction (direction perpendicular to the plane of paper showing FIG. 3), a plurality of connection passages 23 are arranged along the long-side direction, and a plurality of pressure chambers 24 are arranged above the connection passages 23 along the long-side direction. The common ink chamber 22 is communicated with one end portion of the pressure chambers 24 through the connection passage 23. The connection passage 23 is cranked and formed by connecting the through hole 12*b* of the first connection passage plate 12 and the recessed groove 13*b* and the communication hole 13*c* of the second connection passage plate 13. The pressure chambers 24 are formed such that upper openings of the pressure chamber holes 11*b* of the pressure chamber plate 11 are closed by a lower surface of the actuator 3, and lower openings of the pressure chamber holes 11*b* of the pressure chamber plate 11 are closed by the first connection passage plate 12. The other end portion of the pressure chamber 24 is communicated with the nozzle 18*a* of the nozzle plate 18 through an outflow passage 25 formed by vertically connecting the holes 12*c*, 13*d*, 14*b*, 15*b*, 16*d*, and 17*a* of the plates 12 to 17. A lower end of each nozzle 18*a* opens on the lower surface of the nozzle plate 18, and this opening serves as the ejection opening 26 for ejecting the ink.

In the passage unit 2 configured as above, the ink supplied from an ink supply source, such as an ink cartridge, through the filter 10 (see FIGS. 1 and 2) to the ink inflow opening 19 (see FIGS. 1 and 2) is filled in the ink passage 20 constituted by the common ink chamber 22, the connection passage 23, the pressure chamber 24, the outflow passage 25, and the nozzle 26.

As shown in FIG. 3, the actuator 3 is configured to include piezoelectric sheets 30 to 35 and an insulating top sheet 36 which are stacked in this order. Each of the piezoelectric sheets 30 to 35 is made of a ceramics material of lead zirconate titanate (PZT) and has a thickness of about 30 μm. A common electrode 37 arranged to correspond to all the pressure chamber holes 11*b* of the passage unit 2 is printed on each of upper surfaces of the piezoelectric sheets 30, 32, and 34 which are odd-numbered sheets when the piezoelectric sheets 30 to 35 are counted from the piezoelectric sheet 30 that is a lowermost layer. Moreover, a large number of individual electrodes 38 arranged to correspond to the pressure chamber holes 11*b*, respectively, are printed to form five columns on each of upper surfaces of the piezoelectric sheets 31 and 33 which are even-numbered sheets. The common electrode 37 and the individual electrodes 38 are electrically connected to the surface electrodes 39 (see FIG. 3) formed on an upper surface of the top sheet 36 that is an uppermost sheet through a relay wire (not shown) disposed on side end surfaces of the piezoelectric sheets 30 to 35 and the top sheet 36 or in through holes (not shown) of the piezoelectric sheets 30 to 35 and the top sheet 36, and the common electrode 37 is connected to a constant potential (ground potential for example).

In accordance with the ink jet head 1 configured as above, when the drive circuit of the IC chip 4*a* (see FIG. 1) outputs the electric signal to selectively apply a voltage to the individual electrode 38, the potential difference is generated at an active portion between the individual electrode 38 to which the voltage is applied and the common electrode 37. Thus, an electric field acts on the active portion, and this causes distortion of the active portion in a stack direction. When the active portion distorts in this manner, the piezoelectric sheet 30 that is the lowermost layer projects into the pressure chamber 24 to increase an internal pressure of the pressure chamber 24. Therefore, the ink increased in pressure flows through the outflow passage 25 and is ejected downwardly from the ejection opening 26 of the nozzle 18*a*.

At this time, ink ejection pressure generated in the pressure chamber 24 is also transmitted through the connection passage 23 into the common ink chamber 22. By this ejection pressure, a damper wall 28 elastically deforms in the downward direction, and this increases the volume of the common ink chamber 22. The increase in the volume of the common ink chamber 22 is absorbed by the damper chamber 29. Therefore, the ejection pressure of the common ink chamber 22 is damped. Thus, by the movement of the damper wall 28, the phenomenon (so-called cross talk) in which the ejection pressure is transmitted to the other connection passage 23 communicated with the common ink chamber 22 and this causes the ink to be ejected from the ejection opening 26 of the undesired nozzle 18*a* can be suppressed.

Figure 4:
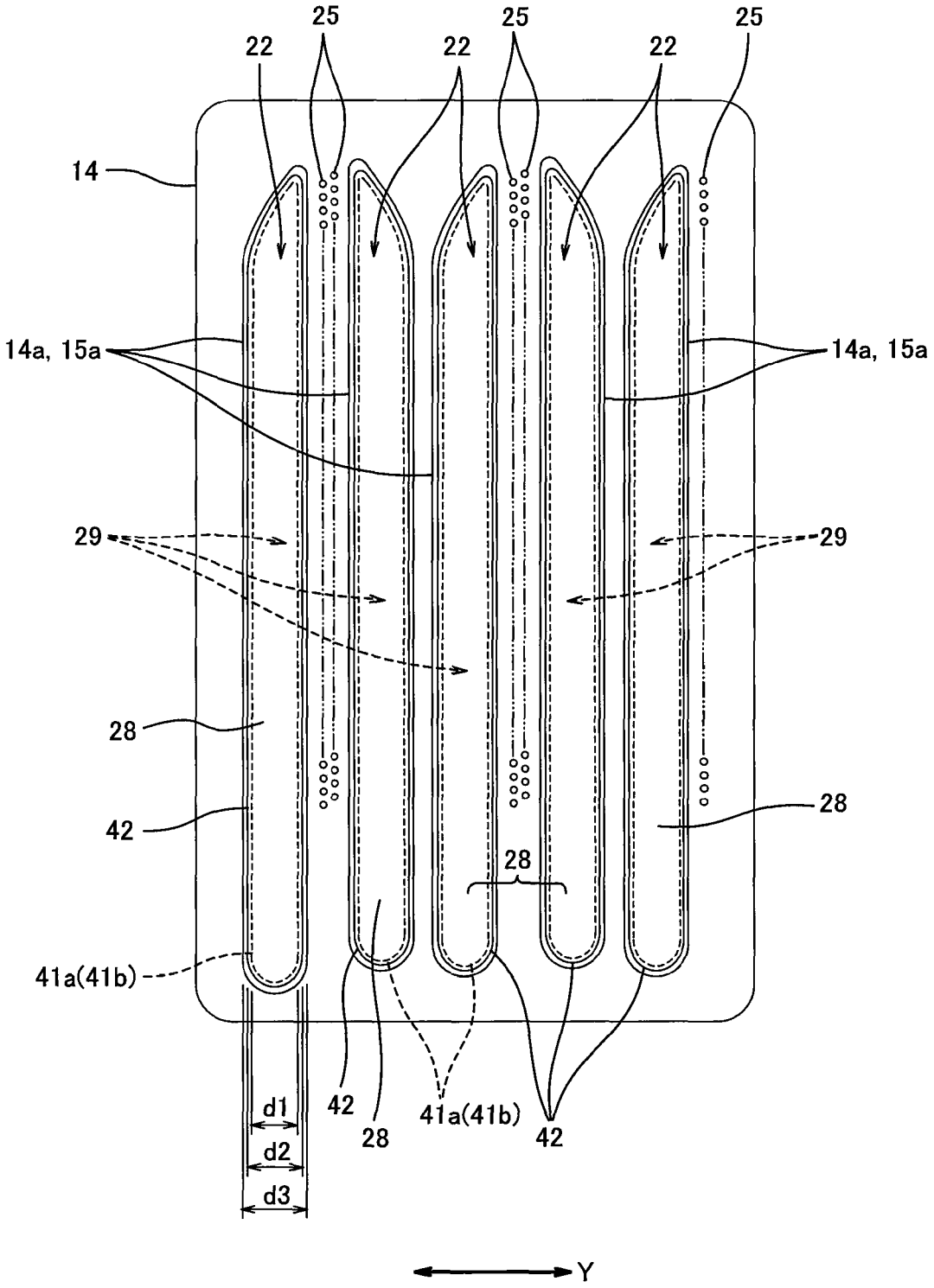
FIG. 4 shows the passage unit in plan view, and is a partial cross-sectional view taken along line IV-IV of FIG. 3.

Next, the damper plate 16 including the damper wall 28 will be explained. FIG. 4 shows the passage unit 2 in plan view, is a cross-sectional view taken along line IV-IV of FIG. 3, and is a plan view showing a state where the damper plate 16 is adhesively stacked on a lower side of the manifold plates 14 and 15 when viewed from above the manifold plates 14 and 15. As shown in FIGS. 3 and 4, the damper plate 16 is a two-layer composite plate formed by stacking the resin portion 42 on the metal base portion 41 having the same rectangular shape as the other plates in plan view.

The manifold hole 14*a* of the manifold plate 14 and the manifold hole 15*a* of the manifold plate 15 extend in the X direction (the width (Y-direction dimension) of each of the manifold hole 14*a* and the manifold hole 15*a* is d3). The recess 41*a* of the damper plate 16 opens on the lower surface of the base portion 41 so as to be located at a position corresponding to each of the manifold holes 14*a* and 15*a*, have the same contour shape as each of the manifold holes 14*a* and 15*a*, but be smaller in the contour shape than each of the manifold holes 14*a* and 15*a*. To be specific, the recess 41*a* is formed to have a width (Y-direction dimension) d1 smaller than the width d3 of each of the manifold holes 14*a* and 15*a*. In addition, the resin portion 42 having the same contour shape as each of the manifold holes 14*a* and 15*a* in plan view is adhesively stacked on an upper surface of a thin portion 41*b* left by forming the recess 41*a* on the base portion 41 and is located at a position corresponding to the recess 41*a*. The resin portion 42 is formed to be smaller than each of the manifold holes 14*a* and 15*a* and larger than the recess 41*a*. To be specific, the relation among the width (Y-direction dimension) d2 of the resin portion 42, the width d1 of each of the manifold holes 14*a* and 15*a*, and the width d3 of the recess 41*a* is represented by d3>d2>d1. Therefore, in plan view, contour lines of the recess 41*a* and the resin portion 42 are located inside the contour lines of the first and second manifold holes 14*a* and 15*a*. Therefore, with the plates 14, 15, and 16 adhesively stacked on one another, the resin portion 42 is stored in the manifold holes 14*a* and 15*a* (also see FIG. 3). On this account, as shown in FIG. 3, a bottom wall of the common ink chamber 22 except for an outer peripheral edge portion of the bottom wall constitutes the damper wall 28. That is, the damper wall 28 defining the common ink chamber 22 and the damper chamber 29 is constituted by the thin portion 41*b* of the base portion 41 and the resin portion 42 stacked on the thin portion 41*b*.

As above, the passage unit 2 is formed such that the resin portion 42 is stored in the manifold hole 15*a*, and only large-width portions of the base portion 41 of the damper plate 16 are adhesively stacked between the manifold plate 15 and the cover plate 17. Therefore, the resin portion 42 does not exist in the outflow passage 25. On this account, the outflow passage 25 can be easily formed, and the ink passage 20 can be shortened by the thickness of the resin portion 42. As a result, ink passage resistance of the ink passage 20 can be reduced, and the drive voltage of the actuator 3 for ejecting the ink can be suppressed to low levels. Moreover, the lower surface of the second manifold plate 15 is bonded to the upper surface of the base portion 41 (see FIG. 3). Therefore, the damper plate 16 and the second manifold plate 15 are adhesively stacked on each other in an appropriate manner without the occurrence of separation between the damper plate 16 and the second manifold plate 15. Moreover, the entire thickness of the ink jet head 1 can be reduced while adequately securing required flexibility of the damper wall 28. Therefore, this contributes to the reduction in size of the ink jet head 1.

Especially in the present embodiment, since the thin portion 41*b* made of a metal is formed on a damper-space-side surface of the resin portion 42, air intrusion from the damper chamber 29 to the common ink chamber 22 can be effectively prevented by the thin portion 41*b*.

Figure 5A:
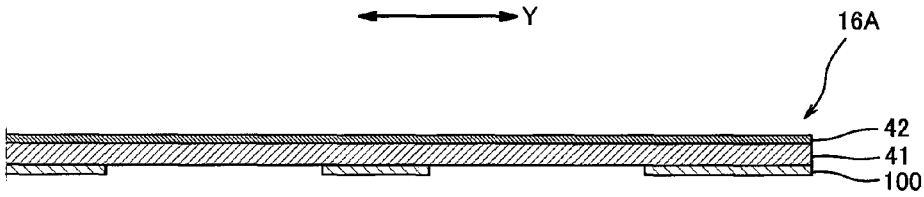
FIG. 5 are explanatory diagrams of a method for manufacturing a damper plate shown in FIG. 2.

Next, a method for manufacturing the damper plate 16 described above will be explained in reference to FIG. 5. FIG. 5 show the damper plate 16 or a substrate 16A of the damper plate 16, and are partial cross-sectional views taken along the same plane as FIG. 3. First, as shown in FIG. 5A, when manufacturing the damper plate 16, the substrate 16A is formed by stacking a resin layer 420 made of synthetic resin, such as polyimide, polyamide, polyethylene terephthalate, or the like, on the entire surface of the metal base portion 41 made of nickel alloy steel, stainless steel, or the like. The base portion 41 has a thickness of 50 to 150 μm, and the resin layer 420 has a thickness of about 10 to 30 μm. As the damper plate 16, a commercial product may be used, which is manufactured by bonding the base portion 41 and the resin layer 420 with an adhesive or by integrating the base portion 41 and the resin layer 420 by thin film formation, such as printing, deposition, or the like. Or, the damper plate 16 may be separately manufactured. In the present embodiment, the damper plate 16 is constituted by two layers that are the base portion 41 and the resin layer 420. However, the damper plate 16 may be constituted by a larger number of layers. Then, the lower surface of the base portion 41 on which surface the resin layer 420 is not formed is masked by a resist pattern 100 except for a region A1 corresponding to the thin portion 41*b* which becomes the damper wall 28.

Figure 5B:
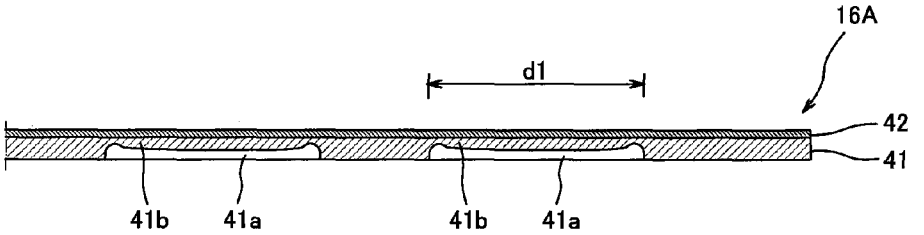

Next, as shown in FIG. 5B, the substrate 16A is moved into a space where etching liquid is sprayed in a vertical direction to be filled in the form of mist. Then, the region A1 that is an exposed portion which is not covered with the resist pattern 100 is subjected to half etching. Thus, the recess 41*a* (damping space) having the width (Y-direction dimension) d1 is formed. By forming the recess 41*a*, the thin portion 41*b* (width (Y-direction dimension) d1) that is a remaining portion of the base portion 41 is formed. The recess 41*a* is formed at a position corresponding to each of the first and second manifold holes 14*a* and 15*a* (see FIG. 3). The thin portion 41*b* has a thickness of about 8 to 15 μm.

Figure 5C:
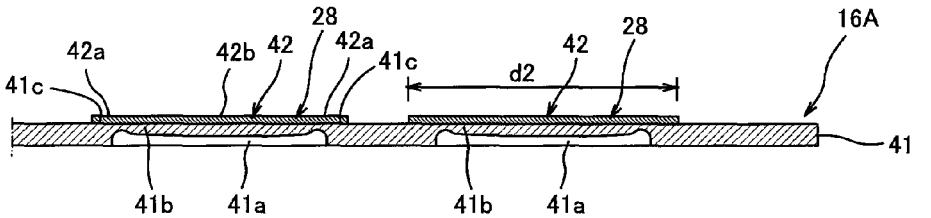

Next, as shown in FIG. 5C, a resist pattern, not shown, is formed on the resin layer 420, and the resin layer 420 is removed by etching such that the resin portion 42 covers only a portion above and around the recess 41*a*. At this time, in plan view, the resin portion 42 (width (Y-direction dimension) d2) is formed to be larger in the contour shape than at least each of the recess 41*a* and the thin portion 41*b*, the overall size of the resin portion 42 is set to be able to be stored in the first and second manifold holes 14*a* and 15*a* (width (Y-direction dimension) d3 (see FIG. 5E)), and the resin portion 42 is formed to be able to entirely cover the upper surface of the thin portion 41*b* (d3>d2>d1). In the present embodiment, a flange portion 41*c* of the thin portion 41*b* is covered with a peripheral portion 42*a* of the resin portion 42. Therefore, the thin portion 41*b* is entirely covered with the resin portion 42. The thin portion 41*b* and a covering portion 42*b* which is a part of the resin portion 42 and covers the thin portion 41*b* constitute the damper wall 28 which is elastically deformable in the vertical direction.

Figure 5D:
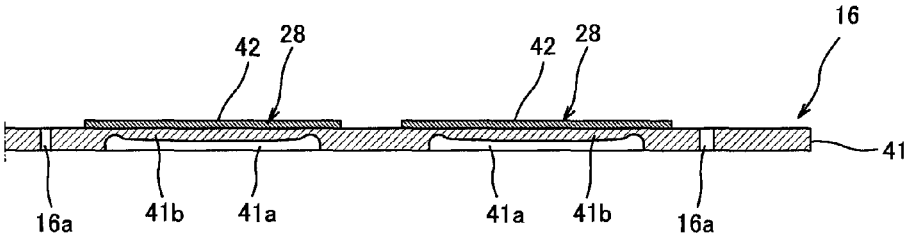
Figure 5E:
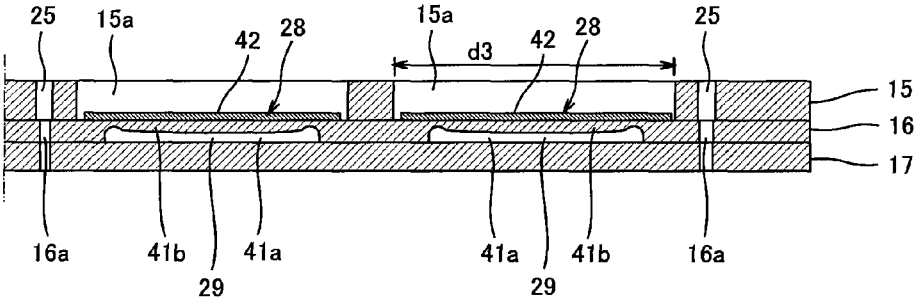

Next, as shown in FIG. 5D, the outflow through hole 16*a* is formed on the base portion 41 by laser beam machining, etching, or the like. The outflow through hole 16*a* is not formed on the resin portion 42 since the resin portion 42 has already been removed. Thus, the damper plate 16 is manufactured. Then, as shown in FIG. 5E, the second manifold plate 15 is stacked on an upper surface of the damper plate 16 such that the resin portion 42 is stored in the manifold hole 15*a*, and the cover plate 17 is stacked on a lower surface of the damper plate 16.

After the step of FIG. 5A, first, the resin layer 420 may be etched, and then, the recess 41*a* and the outflow through hole 16*a* may be formed by etching at the same time.

The damper wall 28 of the present embodiment is formed such that the upper surface of the thin portion 41*b* of the damper plate 16 is covered with the resin portion 42. Therefore, when forming the recess 41*a* to form the thin portion 41*b* of the damper plate 16 in order to improve the flexibility of the damper wall 28 to increase the damper effect, the thin portion 41*b* can be made thinner than before by etching. To be specific, even if a gap is formed on the thin portion 41*b* due to the impurity in the raw material of the base portion 41 by forming the recess 41*a* more deeply and forming the thin portion 41*b* more thinly than before, the ink in the common ink chamber 22 can be prevented from intruding into the damper chamber 29 through the gap, since the resin portion 42 is formed on the upper side of the gap. Therefore, since the thin portion is thinner than before, it is possible to obtain higher damper effect than before even through the resin portion is stacked on the thin portion.

Alternatively, the damper plate may be formed by adhesively stacking the resin portion 42 preformed in a predetermined shape on the base portion 41 on which the recess 41*a* is formed. However, in this case, since the stiffness of the damper plate itself is reduced by forming the recess and the thin portion on the damper plate which is originally thin, handling of the damper plate is not easy, and it may be difficult to smoothly proceed the step of forming the damper plate. As in the present embodiment, by adopting the method for removing by etching the resin layer 420 covering the entire surface of the base portion 41, the resin portion 42 having a desired shape can be easily and surely formed on a desired position.

Moreover, the recess 41*a* is formed by half-etching the base portion 41 using the etching liquid. In this case, the etching liquid tends to flow along a peripheral portion of the region A1, and the flow velocity of the etching liquid tends to be high in the peripheral portion, so that a peripheral portion of the recess 41*a* tends to be etched more deeply than a central portion of the recess 41*a*. Therefore, in a case where the thickness of the thin portion 41*b* is set based on the central portion, the peripheral portion is etched more deeply than a desired size. This increases the possibility that a partial damage, crack, or the like is caused by fall-off of the impurity. In the present embodiment, since the resin portion 42 is stacked on the upper side of the thin portion 41*b*, sealing between the common ink chamber 22 and the damper chamber 29 can be secured even at the peripheral portion of the recess 41*a*.

Figure 6:
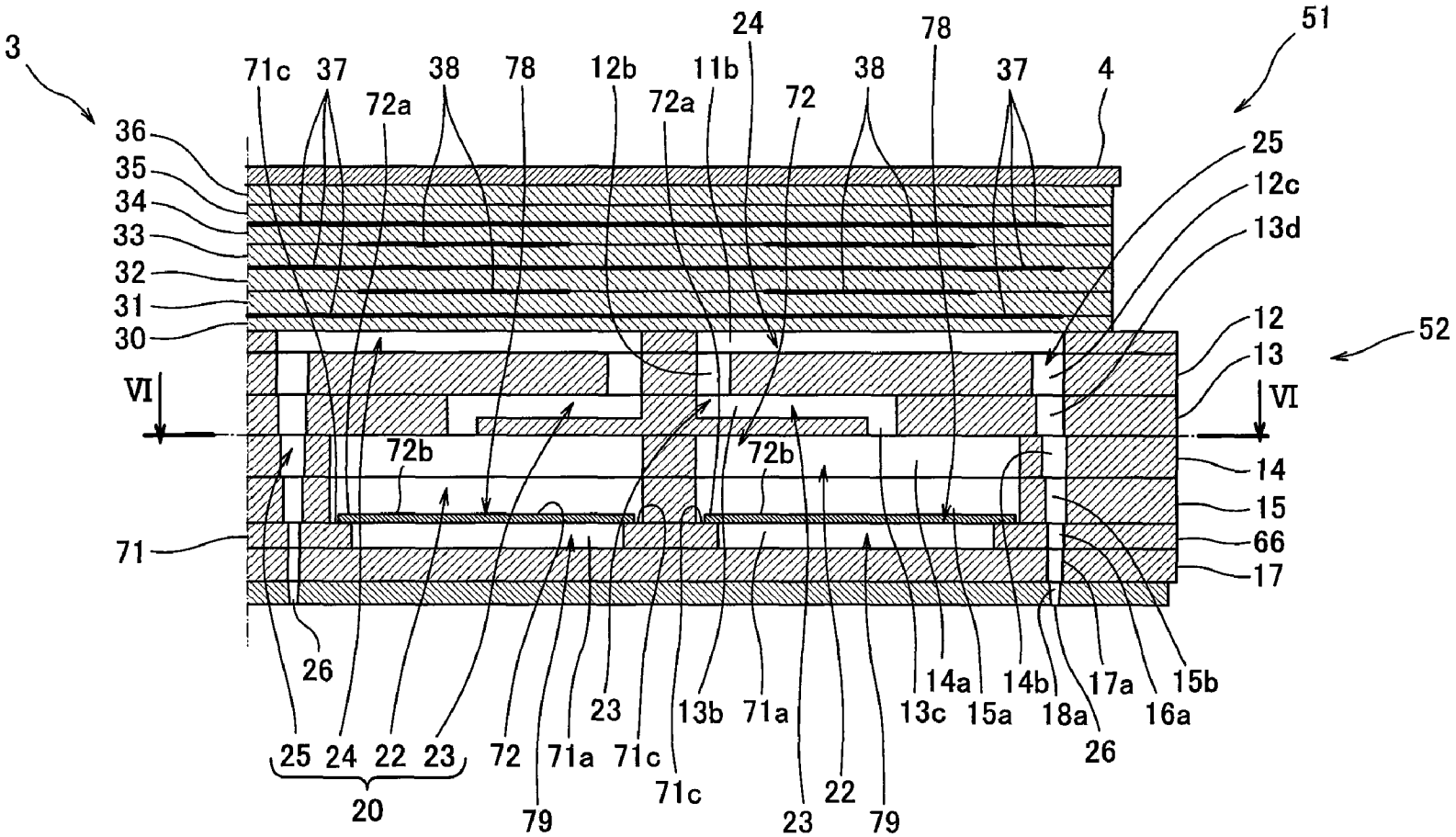
FIG. 6 is a partial cross-sectional view of the ink jet head including the passage unit according to Embodiment 2 of the present invention.
Figure 7:
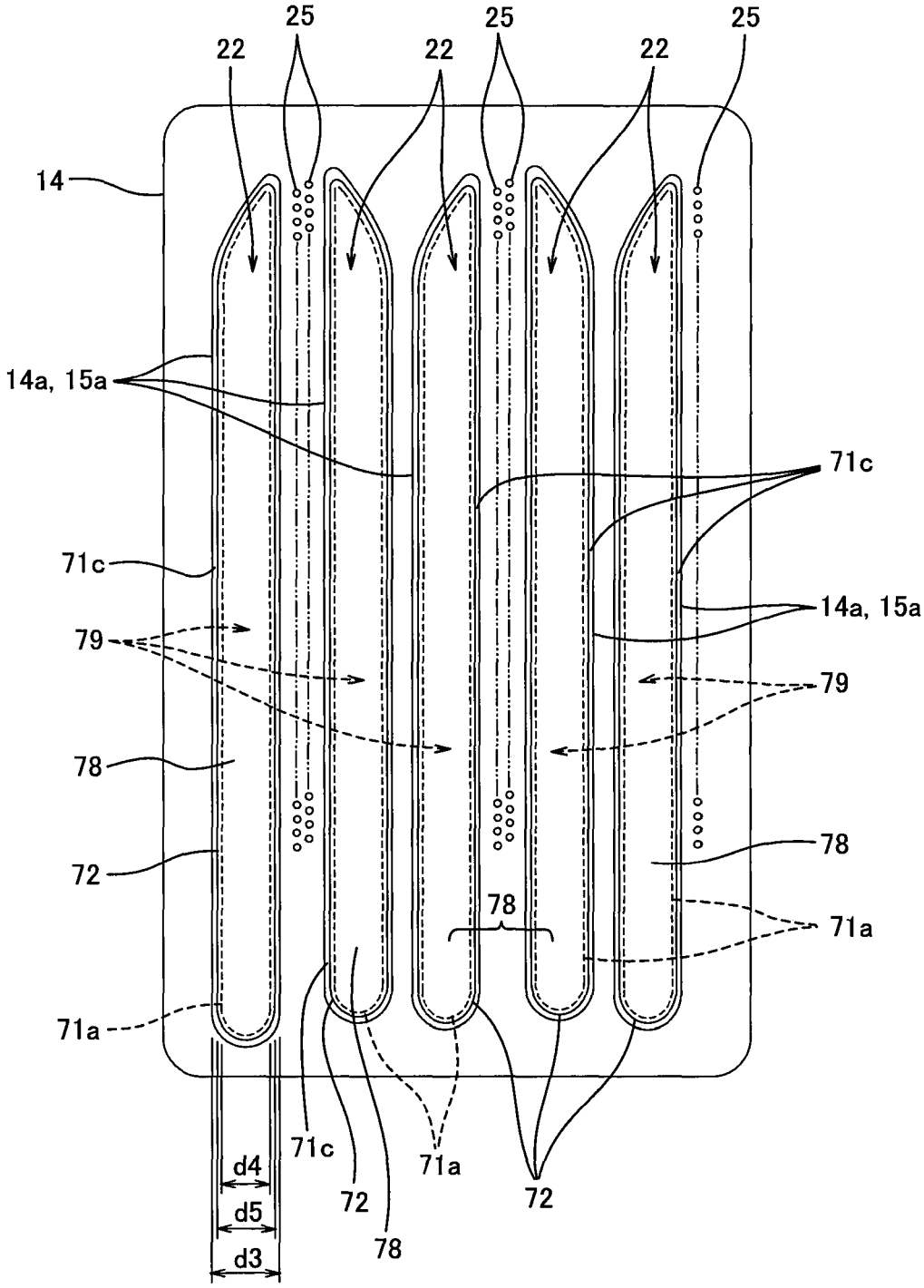
FIG. 7 shows the passage unit in plan view, and is a partial cross-sectional view taken along line VIII-VIII of FIG. 6.

FIG. 6 is a partial cross-sectional view of an ink jet head 51 according to Embodiment 2 of the present invention. FIG. 7 shows a passage unit 52 in plan view, is a cross-sectional view taken along line VI-VI of FIG. 6, and is a plan view showing a state where the plates are adhesively stacked on one another when viewed from above the first manifold plate 14. Differences between Embodiments 1 and 2 will be mainly explained in the present embodiment. Same reference numbers are used for the same components, and a repetition of the same explanation is avoided.

As shown in FIGS. 6 and 7, in a damper plate 66, a damper through hole 71*a* having a width (Y-direction dimension) d4 is formed on the base portion 71, and a resin portion 72 including a covering portion 72*b* covering an upper opening of the damper through hole 71*a* is partially stacked on an upper surface of the base portion 71 to be located at a position where the damper through hole 71*a* is formed. The resin portion 72 has a width (Y-direction dimension) d5. In plan view, the damper through hole 71*a* and the resin portion 72 are formed at a position corresponding to the manifold hole. Moreover, in plan view, the manifold hole (width (Y-direction dimension) d3) is larger in the contour shape than each of the damper through hole 71*a* and the resin portion 72. Specifically, the relation between the widths d3, d4, and d5 is represented by d3>d4>d5. Therefore, with the manifold plate 15 adhesively stacked on the damper plate, the resin portion 72 is stored in the manifold hole 15*a*.

With this, the bottom wall of the common ink chamber 22 except for an outer edge portion of the bottom wall constitutes a damper wall 78 which is elastically deformable in the vertical direction. A damper chamber 79 which is divided from the common ink chamber 22 by the damper wall 78 is formed in the damper plate 66. The damper chamber 79 is formed by closing the lower opening of the damper chamber 79 by the upper surface of the cover plate 17.

FIG. 8 are diagrams for explaining a method for manufacturing the damper plate according to the present embodiment. When manufacturing the damper plate 66 of the present embodiment, first, as with Embodiment 1, a substrate 66A is constituted by the base portion 71 and a resin layer 720 (see FIG. 8A). Then, the lower surface of the base portion 71 is masked by the resist pattern 100 except for the region A1 corresponding to the damper through hole 71*a*.

Figure 8A:
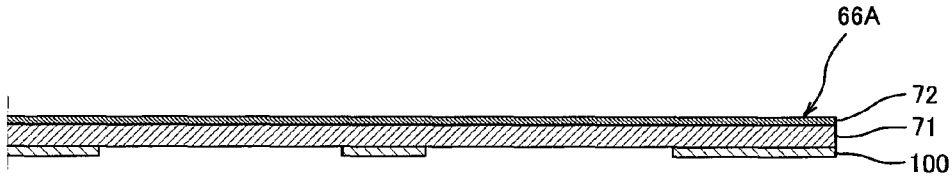
FIG. 8 are explanatory diagrams of a method for manufacturing the damper plate according to Embodiment 2 of the present invention.
Figure 8B:
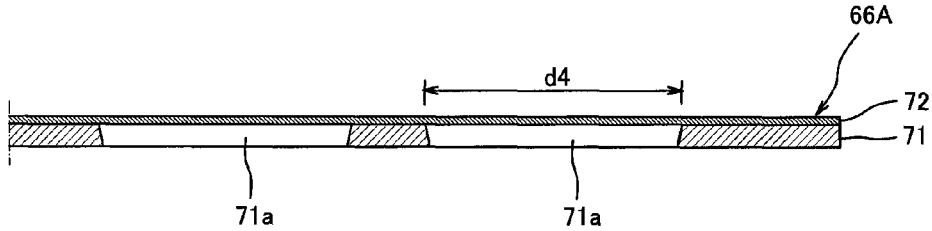

Next, as shown in FIG. 8B, the damper through hole 71*a* (damping space) (width (Y-direction dimension) d4) is formed on the base portion 71 by etching the lower surface of the base portion 71. The damper through hole 71*a* is formed at a position corresponding to the first and second manifold holes 14*a* and 15*a*.

Figure 8C:
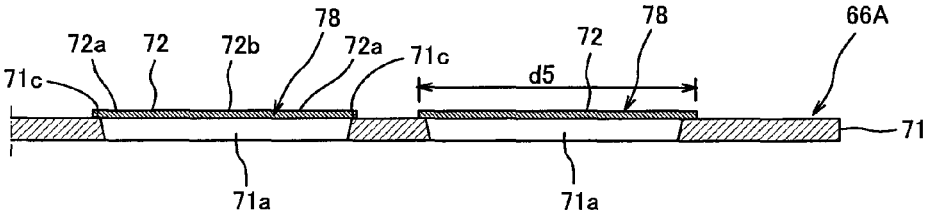
Figure 8D:
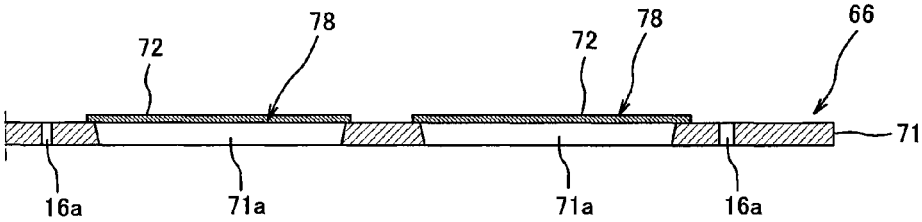
Figure 8E:
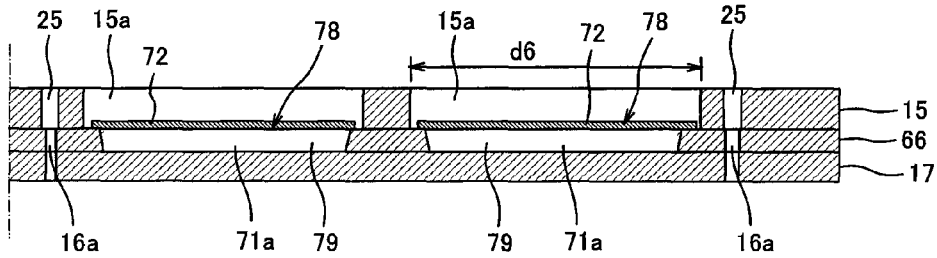

Next, as shown in FIG. 8C, the resin layer 720 is partially removed by etching so as to cover only a portion above and around the damper through hole 71*a*. With this, the resin portion 72 (width (Y-direction dimension) d5) is formed on the upper surface of the base portion 71 such that a peripheral portion 72*a* of the resin portion 72 is bonded to a flange portion 71*c* formed around an upper opening of the damper through hole 71*a* (d5>d4). As above, the covering portion 72*b* which covers the upper opening of the damper through hole 71*a* constitutes the damper wall 78 which is elastically deformable in the vertical direction. Next, as shown in FIG. 8D, as with Embodiment 1, the outflow through hole 16*a* is formed on the base portion 71 by laser beam machining, etching, or the like.

As above, in the present embodiment, the damper wall 78 is constituted by only the resin portion 72 having flexibility, and a high damping effect can be obtained. Moreover, in plan view, the resin portion 72 is larger in the contour shape than the damper through hole 71*a*. Therefore, the resin portion 72 can cover the upper opening of the damper through hole 71*a* regardless of tolerances in forming the damper through hole 71*a* by etching, the ink does not intrude from the peripheral portion of the damper through hole 71*a* into the damper chamber, and the air in the damper chamber 79 does not intrude into the common ink chamber 22. Moreover, as with Embodiment 1, the outflow through hole 16*a* for forming the outflow passage 25 does not have to be formed on the resin portion 72.

The above embodiments can be suitably modified without departing from the scope of the present invention. For example, the foregoing has explained a case where the liquid droplet ejection head is the ink jet head mounted on the ink jet printer. However, the present invention is not limited to this. The present invention is applicable to other liquid droplet ejection heads of liquid droplet ejecting devices, such as devices configured to apply colored liquid as fine liquid droplets and devices configured to eject electrically-conductive liquid to form wiring patterns.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A liquid droplet ejection head comprising:

a passage unit including:

a plurality of pressure chambers each configured to be communicated through an outflow passage with each of a plurality of nozzles configured to eject liquid droplets;

a common liquid chamber configured to supply liquid from a liquid supply source to the pressure chambers; and a damper chamber configured to absorb pressure fluctuations of the common liquid chamber; and an energy generator configured to apply an ejection pressure to the liquid in the pressure chamber;

wherein the passage unit includes:

a manifold plate having a manifold hole constituting the common liquid chamber; and a damper plate which is stacked on the manifold plate and includes a damper wall facing the common liquid chamber and having flexibility;

wherein the damper plate includes:

a base portion on which a damping space constituting the damper chamber is formed at a position corresponding to the manifold hole in plan view; and a resin member disposed on one surface of the base portion which surface faces the manifold plate; and wherein the resin member is provided to cover at least a portion above and around the damping space so as to form the damper wall, and is smaller in a contour shape than the common liquid chamber in plan view so as to be stored in the manifold hole.

2. The liquid droplet ejection head according to claim 1;

wherein the damping space is smaller in the contour shape than the resin member in plan view.

3. The liquid droplet ejection head according to claim 1;

wherein the damping space is constituted by a recess formed on one surface of the base portion which surface is opposite a surface facing the common liquid chamber; and wherein the damper wall is constituted by a thin portion left by forming the recess on the base portion, and a covering portion which is a part of the resin member and covers the thin portion.

4. The liquid droplet ejection head according to, claim 3;

wherein the recess is formed by half-etching a region corresponding to the recess.

5. The liquid droplet ejection head according to claim 1;

wherein the damping space is constituted by a through hole penetrating through the base portion; and wherein the damper wall is constituted by a covering portion which is a part of the resin member and covers one opening of the through hole.

6. The liquid droplet ejection head according to claim 1;

wherein the passage unit further includes a nozzle plate forming the nozzles and a pressure chamber plate forming the pressure chambers; and wherein the pressure chamber plate, the manifold plate, the damper plate, and the nozzle plate are staked in this order in a stack direction.

* * * * *